US006554282B2

(12) United States Patent
VanderKley et al.

(10) Patent No.: US 6,554,282 B2
(45) Date of Patent: Apr. 29, 2003

(54) METHOD OF PLAYING CRIBBAGE IN A CASINO SETTING

(76) Inventors: Kevin VanderKley, #406-10128-132 St., Surrey, British Columbia (CA), V3T 3T5; Craig M. Schaefer, 504 Hidden Ct., Las Vegas, NV (US) 89145

( * ) Notice: Subject to any disclaimer, the term of this patent is extended or adjusted under 35 U.S.C. 154(b) by 0 days.

(21) Appl. No.: 09/895,355

(22) Filed: Jun. 29, 2001

(65) Prior Publication Data

US 2003/0034610 A1 Feb. 20, 2003

(51) Int. Cl.[7] ..... A63F 1/00
(52) U.S. Cl. ..... 273/292; 273/274; 463/11
(58) Field of Search ..... 273/274, 292, 273/309; 463/11–12, 13

(56) References Cited

U.S. PATENT DOCUMENTS

| | | | | |
|---|---|---|---|---|
| 4,651,997 A | | 3/1987 | Wood | |
| 5,288,081 A | | 2/1994 | Breeding | |
| 5,415,414 A | | 5/1995 | Savage | |
| 5,417,430 A | | 5/1995 | Breeding | |
| 5,489,101 A | * | 2/1996 | Moody | 273/292 |
| 5,544,892 A | * | 8/1996 | Breeding | 273/274 |
| 5,597,162 A | | 1/1997 | Franklin | |
| 5,653,635 A | | 8/1997 | Breeding | |
| 5,720,484 A | | 2/1998 | Hsu | |
| 5,820,128 A | | 10/1998 | Brunelle | |
| 5,845,907 A | * | 12/1998 | Wells | 273/292 |
| 5,901,958 A | | 5/1999 | Andrews | |
| 6,079,712 A | | 6/2000 | Eaton et al. | |
| 6,406,020 B1 | * | 6/2002 | Reed | 273/274 |

* cited by examiner

*Primary Examiner*—Benjamin H. Layno
*Assistant Examiner*—Vishu K Mendiratta
(74) *Attorney, Agent, or Firm*—Rob L. Phillips; Quirk & Tratos

(57) ABSTRACT

A modified game of cribbage is played by betting the point score of each hand against a predetermined table of betting odds. In this form the game may be played in a casino setting, on a table provided with designated areas for the placement of bets by each player, the placement of the dealt cards to each betting player and the placement of the cards dealt into the crib. The table top may further include imprints of the payout table along with the display of selected rules of the game.

20 Claims, 2 Drawing Sheets

METHOD OF PLAYING CRIBBAGE IN A CASINO SETTING

BACKGROUND OF THE INVENTION

1. Field of the Invention

The present invention relates to card wagering games, and more particularly to a modification of a cribbage game suitable for awarding multiples of a wager in the course of a casino play.

2. Description of the Prior Art

Casino business enterprises provide a variety of wagering games selected for their entertainment, ease of play, and potential of a large payout. In the best circumstances the selected game should easily arouse the potential players interest, and to avoid a quick onset of boredom the preferred game frequently includes more than one wagering opportunity. These desired attributes are also the attributes that rendered card games like poker, black jack and/or baccarat universally popular and in the course of a visit to a casino one will frequently find densely attended card tables on which these games are played.

Historically other card games have had equal success in their public following, but with lesser appreciation in a casino setting. For example the game of bridge, pinochle or hearts are each widely enjoyed amongst the population but have little attention in a casino. In each instance it is the lack of frequent betting opportunity that has limited the usefulness of these games in spite of their engrossing and attention compelling nature.

Even the games of poker, pinochle and baccarat have often been modified for multiplication of betting opportunities in the prior art. For example, a modification of the game of black jack is described in patent U.S. Pat. No. 5,720,484 issued to Hsu; a modification of a game of poker is described in U.S. Pat. No. 5,901,958 issued to Andrews; U.S. Pat. No. 5,415,414 issued to Savage and others; and even solitaire is suggested as a multiple wagering mechanism in U.S. Pat. No. 5,653,635 to Breeding. While each is suitable for the purposes intended, the foregoing games are selected for their betting strategies and not for the intellectual stimulation associated with games like bridge or pinochle.

One card game that has withstood the test of time is the game of cribbage. The nomenclature of this game by itself speaks of venerable history and its persistence to this day speaks volumes of its intellectual stimulation aspects. Even more than bridge, pinochle or hearts, cribbage is wholly engrossing. Regrettably this attention garnering aspect has not been used successfully, and cribbage is equally absent with bridge, pinochle or hearts in a casino setting. The primary reason for this wholesale omission of cribbage in a casino is the lack of betting variety that it provides and the lack of structure to allow betting. Simply, the protracted scoring method entailed in this widely known card game offers few opportunities for betting and lacks the structure to allow betting. The game of cribbage is therefore wholly unappreciated in casinos. Accordingly modifications for improving the betting options for the game of cribbage are extensively sought and it is one such method that is described herein.

SUMMARY OF THE INVENTION

Accordingly it is the general purpose and an object of the present invention to provide a method for improving the betting options in the game of cribbage.

Other objects of the invention are to modify a game of cribbage in order to allow a variety of statistically determined betting payouts that are effected at the end of each hand rather than at the occurrence of some point score.

Yet further objects of the invention are to provide a method for playing cribbage in which the player is paid at the end of each hand in accordance with a pay table.

Briefly these and other objects are accomplished within the present invention by providing a modification to the game of cribbage in which up to seven players can participate. In a manner similar to five card cribbage, each of the players is dealt five cards, with two cards are then dealt as common cards. The players then each discard two of the cards from their own hands, but unlike the conventional cribbage game, these discarded cards are not used to form an additional hand. Instead the players are awarded a multiple of their bet in accordance with a pay table based on the point counting system based on cribbage. For example, if the player's hand is less than 8 then the house wins the bet; if the players point count is 8 then a push results; if the player wins 9 to 11 points, then even money is paid on his or her bet; if the point count is 12 to 14 the odds are 2–1 and so on until the point count of 28 or better at which time a 250–1 odds are paid on the bet.

In each instance it is the three undiscarded cards that the player has in combination with the two exposed cards in the crib that determine the points in accordance with the conventional point system of the game of cribbage. This point system may be augmented by adding additional points for any flush, where a combination of five cards have the same suit; the cards in a player's hand include a jack of the same suit as any one of the cards in the crib; and any combination of the foregoing two variants.

To further raise the interest in the game a bonus feature may be provided wherein a randomly predetermined hand, a combination or multiple of hands achieves an additional level of play in which the player is paid an additional amount. Such a bonus system may be part of a progressive betting arrangement or may be simply in based on a single hand.

The foregoing modified cribbage arrangement may be carried out with the assistance of a table covering designating the two crib areas for the two cards dealt therein, along with the seven player areas with their bet placements designated, each of the player areas also include a repetition of the pay table herein above specified. In this manner the familiar rules of cribbage are used in a casino setting, taking further advantage of the wide popularity of this game and its well-appreciated assessment of probabilities.

DETAILED DESCRIPTION OF THE INVENTION

A. The Rules of Cribbage

Figure 1:
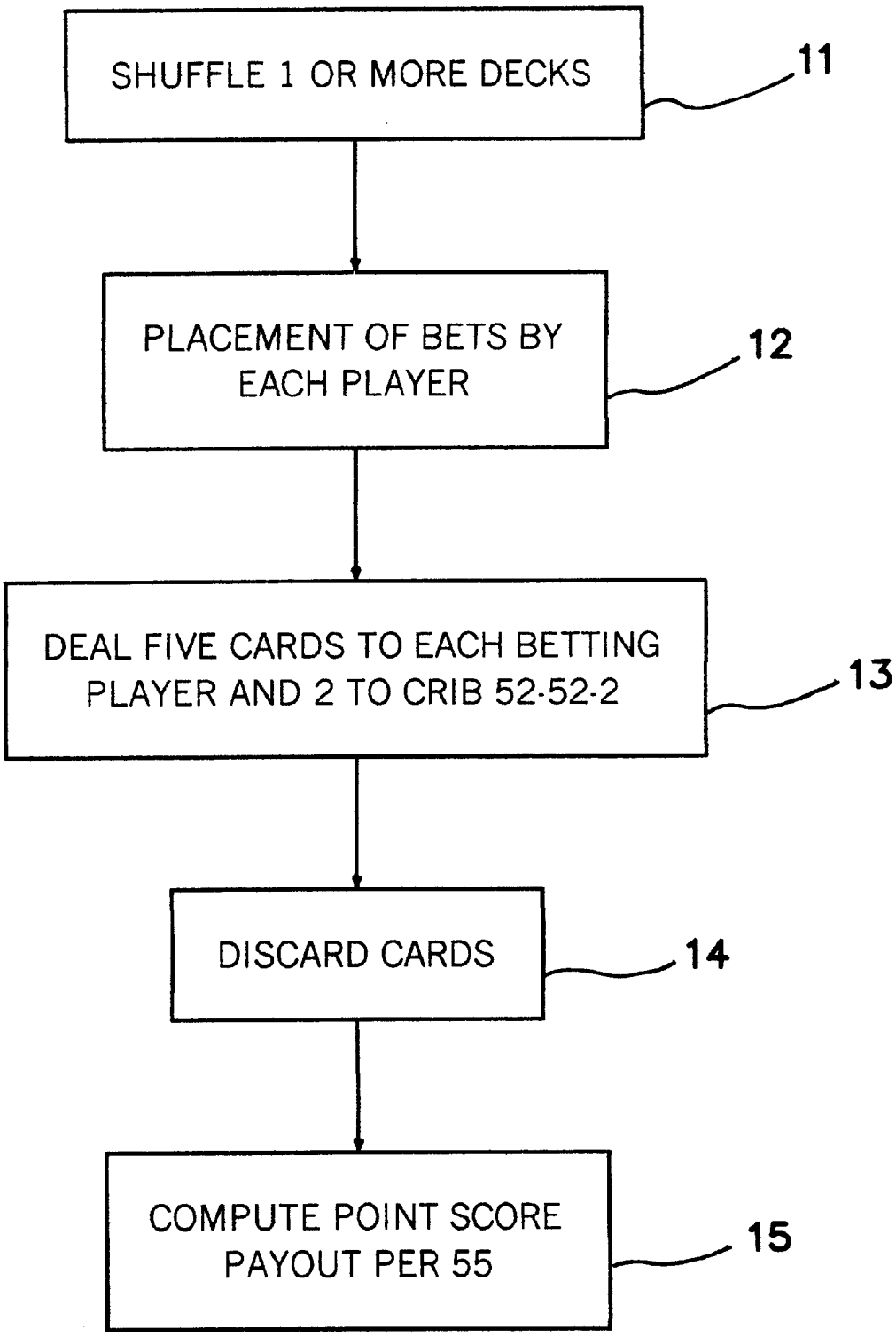
FIG. 1 is a flowchart of the inventively modified Cribbage game.

In order to fully and completely describe the instant invention, a brief reference to the game of cribbage is set out at this point. In its most traditional form cribbage is a game that is known to have been played in the early $17^{th}$ Century and even then it was evolved from an earlier game known as Noddy. Typically it was played by two players, although instances of four players participating in a game, and also three players have been known to exist. In each instance a standard deck consisting of 52 cards is utilized with the card ranking starting at King as the highest and ending Ace at the lowest position. In this early format the one to score the first 61 points was the winner of the game.

To record the point count a perforated board was used on which pegs were moved in one or the other direction depending upon which player earned the points. The holes in each instance presented scores from 1 to 61. The player that reached the last peg hole therefore won the game.

B. The Customary Practices Attendant to Cribbage

In customary practice the players would cut the deck to see who would be the dealer, and the one that obtained the lowest cut card in the course of the cut obtained the dubious award of the dealers position. The dealer then deals five cards to each player along with two cards into the crib and the players then each must discard two cards, leaving three in their respective hands. The discarded cards are then those of the dealer. This game of cribbage had a well-defined point count in which the player of any card that brings the cards total to 15 obtains 2 points ("15–2"); a player of any card which brings the total to 31 scores a further 2 points; a play of the card that is the same as a previous card, i.e., a pair, gains a further 2 points; 3 of a kind "pair royale" obtains 6 points; 4 of a kind "double pair royale" obtains 12 points; and a run of 3 cards or more obtains 3 points. There are further points gained by who has the last card and so on.

Recently, the five card cribbage game has lost favor to the emerging six card game of cribbage which similar to the earlier five card game counts points for 15, 31, a pair, 3 of a kind, 4 of a kind and a run, but which requires a total point count of 121 to determine the winner. This more modem version also obtains. points for a flush, points that had not been earlier awarded.

C. The Present Invention

Regardless of the point count method, the present invention recognizes the statistical difficulty of an increasing point count earned in a single hand. Accordingly, instead of proceeding to a fixed point number, the present invention provides for a payout in accordance with a payout table at the end of each hand. This payout is based, of course, on points earned by the holder of the hand in combination with the two cards that had been earlier dealt into the crib.

Figure 2:
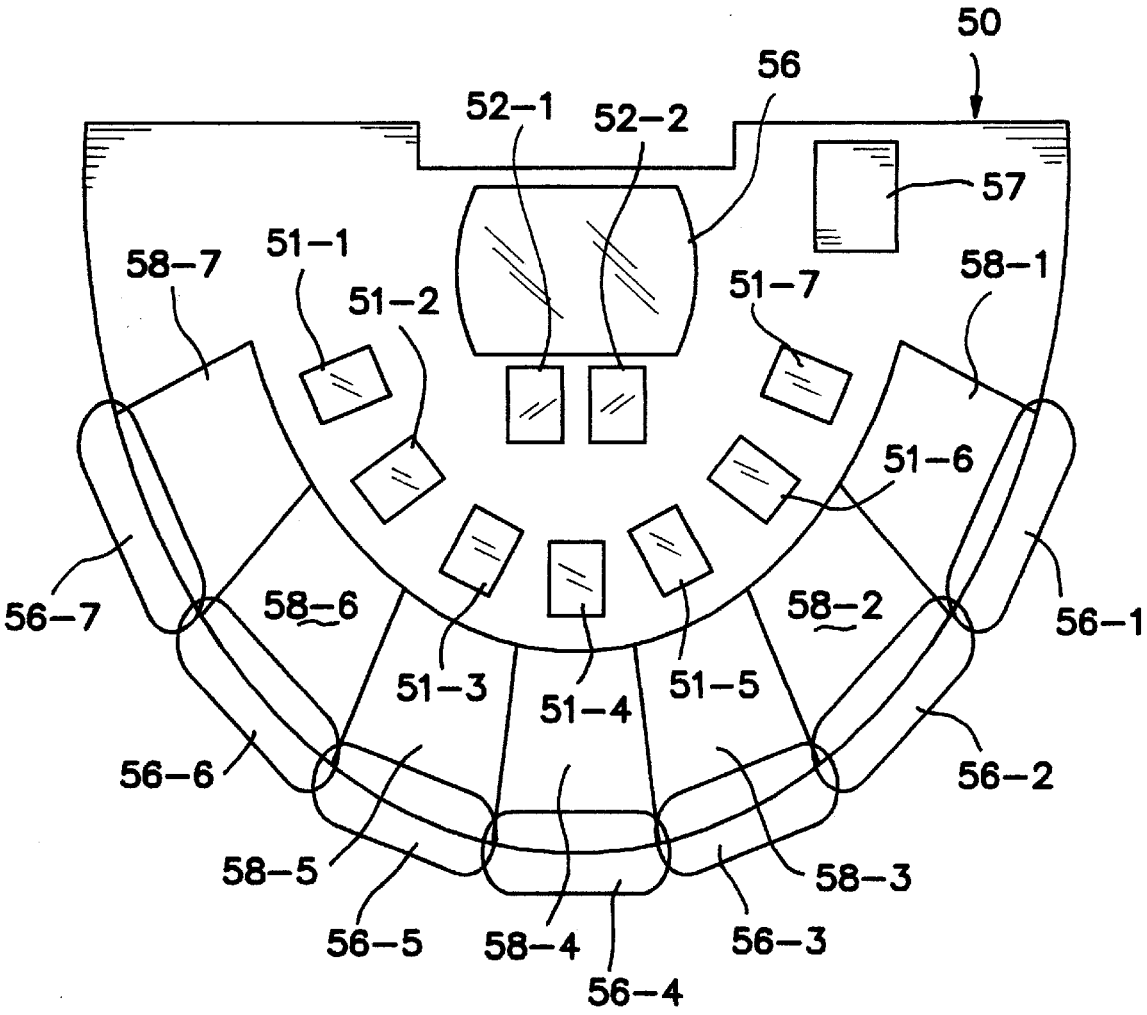
FIG. 2 is a top view of a gaming table covering including the markings and pay tables in accordance with the present invention.

By reference to FIG. 1, the inventive method of play of the game of cribbage, generally designated by the numeral 10, commences with the step of shuffling the deck 11 in which one or more standard 52-card decks are thoroughly shuffled either manually or by way of any of the well known automatic shuffling devices. Thereafter each one of the players at the table is requested to place their bets in the corresponding bet placement areas 51-1 through 51-7 designated therefor on a card table surface 50 illustrated in FIG. 2. This betting step is designated in FIG. 1 by the numeral 12 and once the bets are placed the dealer then may announce "no more bets" as a part of the same step. Then the cards are dealt sequentially to each player that has placed a bet in the corresponding bet placement area until five cards are dealt, in the customary right-to-left sequence, with the last two cards then dealt face down into two designated "crib" areas 52-1 and 52-2, shown as the card dealing and placement step 13. At this point each of the players, having inspected his or her respective hands, discards two selected cards from the hand and these cards are then collected with the undealt cards, all in step 14. In step 15 then the two cards dealt into the "crib" areas 52-1 and 52-2 are exposed and the dealer then evaluates the combined point count of each hand in combination with the crib cards against a payout table 55 repetitively printed on the table surface 50 in front of each player. The dealer then either collects the bet, leaves it in place or pays in accordance with the payout table.

Those, in the art will appreciate that the 'house' payout advantage is often a matter of regulatory control. Accordingly payout schedules are a subject of well defined. statistical analysis. In the example herein a payout schedule that favors the 'house' or the dealer by approximately 1.5% provides the following betting odds:

| POINTS | ODDS |
|---|---|
| 0 | 1–1 |
| 1–7 | Dealer wins |
| 8 | Push |
| 9 to 11 | 1–1 |
| 12 to 14 | 2–1 |
| 15 to 17 | 3–1 |
| 18 to 20 | 5–1 |
| 21 to 23 | 10–1 |
| 24 | 20–1 |
| 28 | 250–1 |

In this manner substantial interest is generated in the course of each hand and the player has a chance to obtain a windfall in each instance. Of course, other permutations and combinations of the number of cards dealt, the number of cards discarded and/or replaced and the number of common cards can be effected. To facilitate the game a card table top 50 may be conformed to the customary geometry Of a casino card table and may include the customary dealer and player chip tray areas 56 and 56-1 through 56-7, respectively, as well as a discard tray 57. Also included on the table 50 may be the card placement areas 58-1 through 58-7 into which each of the players cards are dealt adjacent the bet placement areas 51-1 through 51-7 while the common cards are placed in areas 52-1 and 52-2. Accordingly a well defined set of imprintings on the table top assists in guiding the play of the game.

In this manner a widely familiar card game is adapted to the more exciting levels of play associated with a casino, in a physical implementation that is fully compatible with the current casino facilities. Those that now form the very large ranks of ardent followers of cribbage will therefore obtain a familiar and inviting setting.

Obviously, many modifications and variations can be effected without departing from the spirit of the invention disclosed herein. It is therefore intended that the scope of the invention be determined solely by the claims appended hereto.

What is claimed is:

1. A method of playing a modified game of cribbage comprising the steps of:

shuffling one or more decks of playing cards to obtain a generally random distribution of the individual cards thereof;

placement of bets by each participant in the game;

dealing face down an individual one of the shuffled cards to each said betting participant until a preselected number of cards is accumulated by each participant;

dealing further two cards face down into a common area;

discarding of two cards selected by each said participant from the cards accumulated by said participant;

revealing each said ones of said cards dealt face down to each said betting participant that have not been discarded and said two cards dealt into said common area;

computing the point score of the combination of the undiscarded cards of each said participant and said further two cards in said common area generally in accordance with the rules of point scoring of cribbage; and paying such ones of said participants as have obtained a score greater than a determined value a multiple of said participant's bet in accordance with a predetermined payout table.

2. A method according to claim 1 wherein said step of paying in accordance with a payout table includes the payment of

| POINTS | ODDS |
|---|---|
| 0 | 1–1; |
| 1–7 | Dealer wins; |
| 8 | Push; |
| 9 to 11 | 1–1; |
| 12 to 14 | 2–1; |
| 15 to 17 | 3–1; |
| 18 to 20 | 5–1; |
| 21 to 23 | 10–1; |
| 24 | 20–1; and |
| 28 | 250–1. |

3. A method according to claim 2, wherein:

said steps of dealing said two cards and said cards to each said betting participant includes the further step of dealing onto a card table.

4. A method according to claim 3 including the further step of:

imprinting said card table with said payout table together with an area designated as said common area, a further area designated for placement of bets and an area for accumulating said cards dealt in sequence.

5. A method of playing a modified game of cribbage comprising the steps of:

shuffling one or more decks of playing cards to obtain a generally random distribution of the individual cards thereof;

placement of bets by each participant in the game;

dealing an individual one of the shuffled cards to each said betting participant until a preselected number of cards is accumulated by each participant;

dealing further two cards into a common area;

discarding of two cards selected by each said participant from the cards accumulated by said participant;

computing the point score of the combination of the undiscarded cards of each said participant and said further two cards in said common area generally in accordance with the rules of point scoring of cribbage; and paying such ones of said participants as have obtained a score greater than a determined value a multiple of said participant's bet in accordance with a predetermined payout table.

6. A method according to claim 5 wherein:

said step of dealing further two cards includes dealing said further two cards face down; and said step of computing the point score includes the further step of revealing said further two cards.

7. A method according to claim 6, wherein:

said step of dealing individual ones of said shuffled cards includes the further step of dealing said cards face down; and said step of computing the point score includes the further step of revealing said individual ones of said cards.

8. A method according to claim 5 wherein:

said step of paying in accordance with a payout table includes the payment of

| POINTS | ODDS |
|---|---|
| 0 | 1–1; |
| 1–7 | Dealer wins; |
| 8 | Push; |
| 9 to 11 | 1–1; |
| 12 to 14 | 2–1; |
| 15 to 17 | 3–1; |
| 18 to 20 | 5–1; |
| 21 to 23 | 10–1; |
| 24 | 20–1; and |
| 28 | 250–1. |

9. A method according to claim 8 wherein:

said step of dealing further two cards includes dealing said further two cards face down; and said step of computing the point score includes the further step of revealing said further two cards.

10. A method according to claim 9, wherein:

said step of dealing individual ones of said shuffled cards includes the further step of dealing said cards face down; and said step of computing the point score includes the further step of revealing said individual ones of said cards.

11. A method according to claim 10, wherein:

said steps of dealing said two cards and said cards to each said betting participant includes the step of dealing onto a card table; and imprinting said card table with said payout table together with an area designated as said common area, a further area designated for placement of bets and an area for accumulating said cards dealt in sequence.

12. A method of playing a modified game of cribbage comprising the steps of:

shuffling one or more decks of playing cards to obtain a generally random distribution of the individual cards thereof, and thereafter;

dealing an individual one of the shuffled cards in sequence to each one of such game participants as have placed a bet until a preselected number of cards is accumulated by each said betting participant, and thereafter;

dealing further two cards into a common area, and thereafter;

discarding of two cards selected by each said participant from the cards accumulated by said participant, and thereafter;

computing the point score of the combination of the undiscarded cards of each said participant and said further two cards in said common area generally in accordance with the rules of point scoring of cribbage; and paying such ones of said participants as have obtained a score greater than a determined value a multiple of said participant's bet in accordance with a predetermined payout table.

13. A method according to claim 12 wherein:

said step of dealing further two cards includes dealing said further two cards face down;

said step of dealing individual ones of said shuffled cards includes the further step of dealing said cards face down; and said step of computing the point score includes the further step of revealing said further two cards and revealing said individual ones of said shuffled cards.

14. A method according to claim 13 wherein:

said step of paying in accordance with a payout table includes the payment of

| POINTS | ODDS |
|---|---|
| 0 | 1–1; |
| 1–7 | Dealer wins; |
| 8 | Push; |
| 9 to 11 | 1–1; |
| 12 to 14 | 2–1; |
| 15 to 17 | 3–1; |
| 18 to 20 | 5–1; |
| 21 to 23 | 10–1; |
| 24 | 20–1; and |
| 28 | 250–1. |

15. A card table useful in the course of playing a modified game of cribbage, comprising:

a top table surface inscribed with a first designated area for the placement of bets and dealt cards for each player participating in said modified game of cribbage;

a designated area for the placement of commonly used cards; and an area inscribed with a listing of payout odds and corresponding point totals pursuant to the rules of point scoring of cribbage.

16. A card table according to claim 15, further comprising:

said payout odds includes a point to odds listing of

| POINTS | ODDS |
|---|---|
| 0 | 1–1; |
| 1–7 | Dealer wins; |
| 8 | Push; |
| 9 to 11 | 1–1; |
| 12 to 14 | 2–1; |
| 15 to 17 | 3–1; |
| 18 to 20 | 5–1; |
| 21 to 23 | 10–1; |
| 24 | 20–1; and |
| 28 | 250–1. |

17. A method of playing a modified game of cribbage comprising the steps of: shuffling one or more decks of playing cards to obtain a generally random distribution of the individual cards thereof;

placement of bets by each participant in the game;

dealing face down at least one of the shuffled cards to each said betting participant until a preselected number of cards is accumulated by each participant;

dealing further a predetermined number of cards face down into a common area such that the total number of cards accumulated by each player combined with the number of common cards totals five;

discarding no more than two cards selected by each said participant from the cards accumulated by said participant;

revealing each at least one of said cards dealt face down to each said betting participant that have not been discarded and said cards dealt into said common area;

computing the point score of the combination of the undiscarded cards of each said participant and said further common cards in said common area generally in accordance with the rules of point scoring of cribbage; and paying such ones of said participants as have obtained a score greater than a determined value a multiple of said participant's bet in accordance with a predetermined payout table.

18. A method according to claim 17 wherein:

said step of paying in accordance with a payout table includes the payment of

| POINTS | ODDS |
|---|---|
| 0 | 1–1; |
| 1–7 | Dealer wins; |
| 8 | Push; |
| 9 to 11 | 1–1; |
| 12 to 14 | 2–1; |
| 15 to 17 | 3–1; |
| 18 to 20 | 5–1; |
| 21 to 23 | 10–1; |
| 24 | 20–1; and |
| 28 | 250–1. |

19. A method according to claim 18, wherein:

said steps of dealing at least one card and said common cards to each said betting participant includes the further step of dealing onto a card table.

20. A method according to claim 19 including the further step of:

imprinting said card table with said payout table together with an area designated as said common area, a further area designated for placement of bets and an area for accumulating said cards dealt in sequence.

* * * * *